United States Patent [19]

Lerude et al.

[11] Patent Number: 4,485,365

[45] Date of Patent: Nov. 27, 1984

[54] SMALL CONTACTOR WITH A REMOVABLE SUBSET OF AUXILIARY SWITCHES

[75] Inventors: Gérard Lerude, Poitiers; Jacques Lesoile, Mirebeau, both of France

[73] Assignee: La Telemecanique Electrique, France

[21] Appl. No.: 466,198

[22] Filed: Feb. 14, 1983

[30] Foreign Application Priority Data

Feb. 12, 1982 [FR] France ..... 82 02352

[51] Int. Cl.[3] ..... H01H 51/02

[52] U.S. Cl. ..... 335/132; 335/198; 200/303

[58] Field of Search ..... 335/132, 197, 198, 131; 200/16 A, 303

[56] References Cited

U.S. PATENT DOCUMENTS

| | | | |
|---|---|---|---|
| 3,949,333 | 4/1976 | Freitag et al. | 335/197 |
| 3,962,658 | 6/1976 | Zunft et al. | 335/132 |
| 4,309,683 | 1/1982 | Grunert et al. | 335/132 |

*Primary Examiner*—E. A. Goldberg
*Assistant Examiner*—George Andrews
*Attorney, Agent, or Firm*—William A. Drucker

[57] ABSTRACT

A removable group of auxiliary switches is mounted on the upper surface (4) of the contactor housing by hinging means (28, 29) and resilient locking (32, 33) placed respectively in the area of the base (8) and of partitions (5) which separate the principal terminals (6). The group comprises two switches (make and break). Coupling in this manner makes it possible to increase the number of auxiliary switches without increasing the contactor's frontal or lateral congestion.

8 Claims, 10 Drawing Figures

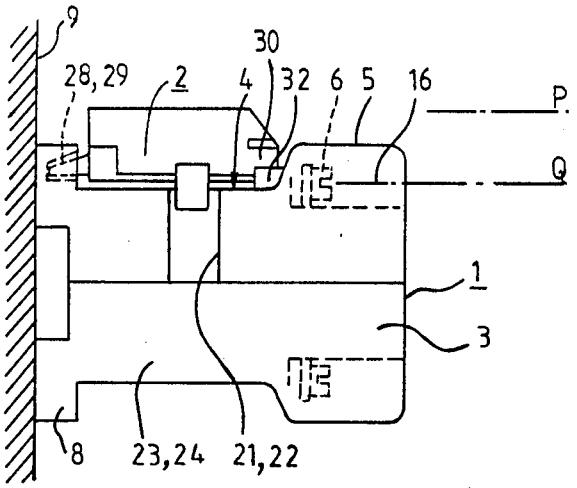
FIG. 1
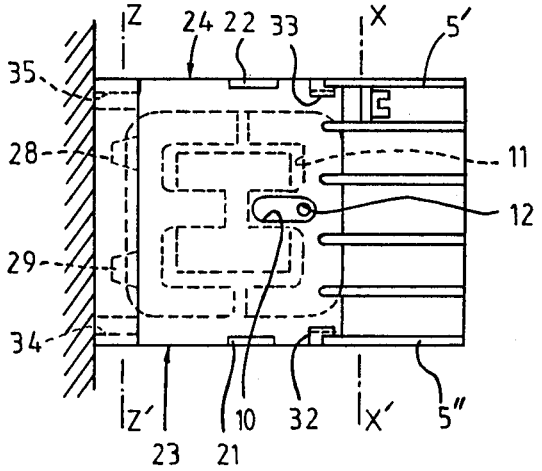
FIG. 2
FIG. 3
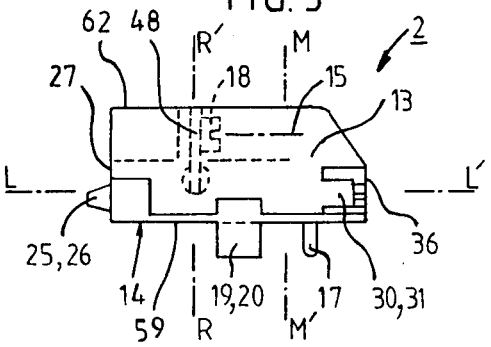
FIG. 4
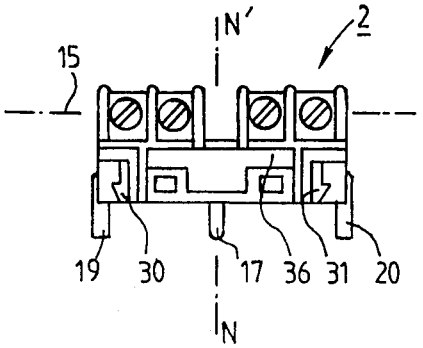

SMALL CONTACTOR WITH A REMOVABLE SUBSET OF AUXILIARY SWITCHES

BACKGROUND OF THE INVENTION

The invention relates to a small contactor with a removable subset of auxiliary switches in which the contactor has two parallel rows of principal terminals, a base for mounting it on a supporting surface, an electromagnet movable armature and a fastening surface adapted for cooperation with the means of fastening of the casing of the subset. The latter includes a slide on which movable contact bridges are mounted. The contact bridges cooperate with fixed contacts that are linked to auxiliary terminals, and coupling means cooperating with the movable armature.

In prior art, the housing of the subset of auxiliary switches is coupled with the contactor, either on the front or a lateral face of the latter. When a group of auxiliary switches is stacked on the front face of a contactor, the depth corresponding to such stacking is increased and it is then not possible to make use of the assembly in boxes, such as those used in domestic equipments, the dimensions of which, once mounting has taken place, are not to exceed standardized dimensions.

When a group of auxiliary switches is mounted on a lateral face, perpendicular to the rows of junction terminals, it is no longer possible to place two contactors side by side and still comply with a uniform layout of the terminals, because a gap, which corresponds to the width of the group, will separate two neighboring contactors.

SUMMARY OF THE INVENTION

It is an object of the invention to provide an auxiliary switch and contactor device of which the overall dimensions either in width or in depth will not exceed that of the contactor proper.

It may appear simple to set a group of auxiliary switches on a side other than the front or lateral side. However, this raises a number of problems or is contrary to a strong prejudice. When the contactor is small, the volume occupied by the junction terminals cannot be below a certain value that is determined either directly from the number of terminals and from precautions for insulation that must be complied with, or from the minimum values that the junction surfaces must have in order to provide determined current intensities without overheating. The result is that the free surface of the other side will be severely limited by the presence of the junction terminals. When the dimensions of the contactor's free face are small, it is not convenient to provide thereon fastening areas capable of receiving a group of auxiliary switches. Finally, it is rare to see switching devices wherein a row of junction terminals for the auxiliary switching devices is located behind the row of junction terminals of the contactor's main contacts, because the sheet of conductors that ends at the main contact terminals is often considered as an obstacle to installation, to connection and to fastening the group of auxiliary switches.

According to a feature of the invention, the desired result is obtained from the fact that the subset's casing is placed against a lateral side of the contactor's body which is parallel to a row of main terminals and which is placed between the fastening base and the insulating partitions which separate said main terminals, the casing having, at one tip, hinging means cooperating with holding means placed on the contactor's body, between the fastening holes of the base and, at a second tip, opposite to the first, locking means which cooperate, by resilient deformation, with further holding means placed on the contactor's body in close vicinity to the row of terminals.

Further features of the invention will appear more clearly upon reading the following description.

BRIEF DESCRIPTION OF THE DRAWINGS

In the appended drawings:

FIG. 1 shows in elevation a contactor with a group of auxiliary switches;

FIG. 2 is a view from above of the contactor illustrated in FIG. 1, but without the group of auxiliary switches;

FIG. 3 is an elevational view of the group of switches;

FIG. 4 is a right-hand side view of the group of switches;

BRIEF DESCRIPTION OF THE PREFERRED EMBODIMENT

Figure 5A:
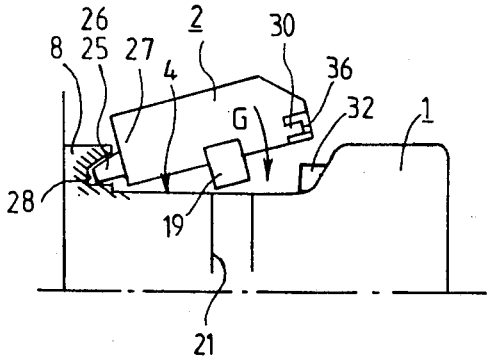
FIG. 5*a* and 5*b* are partial sections of two successive steps of the installation of the group of switches on the contactor.

A small contactor 1 which is fitted with an auxiliary contact device 2 has a body 3 with a flat lateral side 4 forming, at one end, a plurality of parallel insulating partitions 5 which are used to separate power terminals 6 arranged in a row 16 in a plane Q along an axis XX' parallel to this side and a base 8, used for mounting on a support 9. Considering the direction of usual installation of contactors (see FIG. 1), this lateral side 4 is an upper side. The lateral side has an oblong opening 10 behind which there moves parallel to it, a movable armature of electromagnet 11 of the contactor, which is, for example, provided with a coupling hole, slot or groove 12 (see FIG. 2). The subset of auxiliary switches 2, which is mechanically coupled to the contactor (see FIGS. 1 and 3), has a prism-shaped casing 13 which has a flat coupling side 14 that comes to rest against the lateral side 4, a row 15 of auxiliary switching terminals 18, a coupling pin 17 that can work together with the slot 12, as well as means for centering and fastening that will be described below. The row of auxiliary terminals 15 is placed parallel to the row of power terminals 16 when the casing, mounted on the body 3, is located in another plane P.

Means of centering that make it possible to give the casing a very accurate position with respect to the body are formed by two parallel projections 19, 20 of the casing that enter into two parallel grooves 21, 22 of the body 3. The latter are placed on two opposite lateral sides 23, 24, which are perpendicular to the upper lateral side 4 and end thereat (see FIGS. 1 and 2).

The means of fastening the casing on the body include pins 25, 26 which are placed at one tip 27 of the casing and which fit into slots 28, 29 of the body 3, located on or in the area of the base 8. Resilient hooks 30, 31, placed at an opposite tip 36, work together with the flanges 32, 33, placed in the area of the insulating partitions 5; in a preferred embodiment, the slots 28, 29 are set in the area of the fastening holes 34, 35 of the base 8, more precisely between the holes. The flanges 32, 33 are set on two opposite external partitions 5' and 5'' respectively (see FIGS. 2, 3 and 4).

Figure 5B:
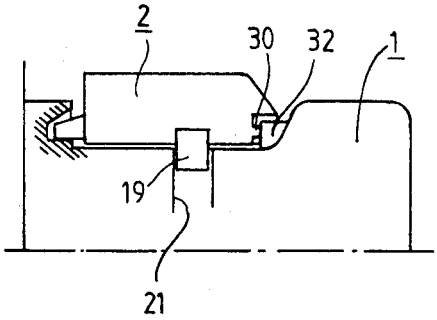

Anchoring the casing on the body (see FIGS 2, 5*a* and 5*b*) is done by first presenting the tip 27 in the area of the base 8 in order to achieve pivoting while working between the pins 25, 26 and the slots 28, 29, and then by downwardly pivoting the opposite tip 36 in the direction of the arrow G. The tip pivots around the axis ZZ' passing through the slots, towards the insulating partitions 5 and does so until resilient snapping into engagement with the partitions 5' and 5''.

The casing 2 of the subset of auxiliary switches 2 has a cover 59 and a half-casing 62 with a substantially central partition 37, parallel to the coupling side 14. The partition divides the casing into one open external volume 47 receiving the auxiliary terminals 18 and into another closed internal volume 38. Inside the internal volume are disposed: two movable contact bridges 39, 40, cooperating with two pairs of fixed contacts, 41 and 42 respectively; a control slide 43 adapted to displace the contact bridges; contact pressure springs, 44, 45, which are coupled to the respective bridges; and a return spring 46, which provides the slide 43 with a rest position (see FIGS 6, 7 and 8). The fixed contacts are borne by reversible and parallel conducting pieces such as 48 which cross the central partition 37 in such a way that the studs of the fixed contacts (and thus later the contact studs of the movable contact bridges) are located in the same plane R parallel to said partition.

The control slide 43 is used to actuate auxiliary make switches F or auxiliary break switches O.

In the first case, contact bridges such as 40, as well as pressure springs 45, are housed respectively in each of two parallel frames 49, 50, which are placed at opposite ends 51, 52 of the slide 43, on both sides of a central cavity 53 having an axis YY'. Thus, the bridges are in the plane SS', visible in FIG. 7. The cavity 53 receives a movable tip of a small return spring 46 of which the other tip is fixed and rests on a wall 68 of the half-casing 62 (see FIGS. 8 and 9). The exterior surface 73 of the wall 68 will be used for guiding of the slide as described below.

Such contact bridges with the make function F are displaced when the slide is coupled to the half-casing, in a first area 54 between the fixed contacts 42 and the tip 36 of the casing.

In the second case, contact bridges such as 39 and pressure springs 44 are first turned over and then placed in a second area 55 of the volume 38 located between the turned over fixed contacts 41 and a bottom 56 constituting the tip 27.

The subset of auxiliary switches 2 may be equipped either with two F (make) or O (break) switches, or with one F and one O switch.

Figure 9:
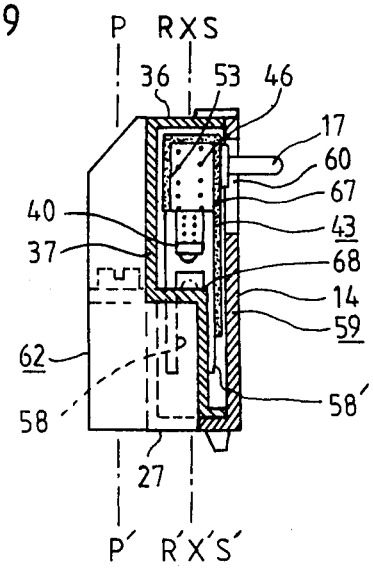
FIG. 9 is a view of the group of auxiliary switches, in section through a plane NN' defined in FIG. 4.
Figure 6:
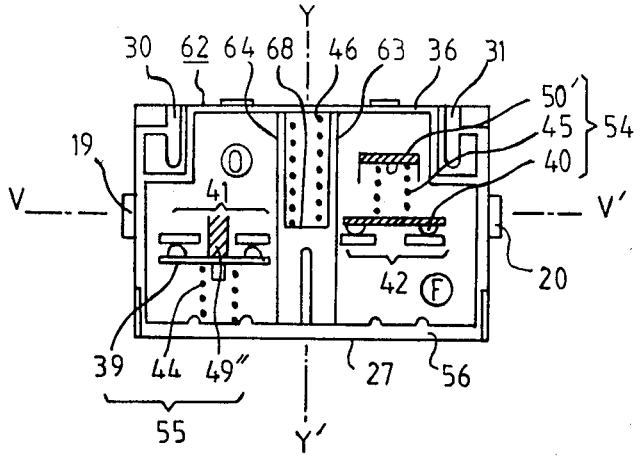
FIG. 6 is a view from beneath of a half-casing of the group of switches without its cover, in half-section through plane LL' of FIG. 3.
Figure 7:
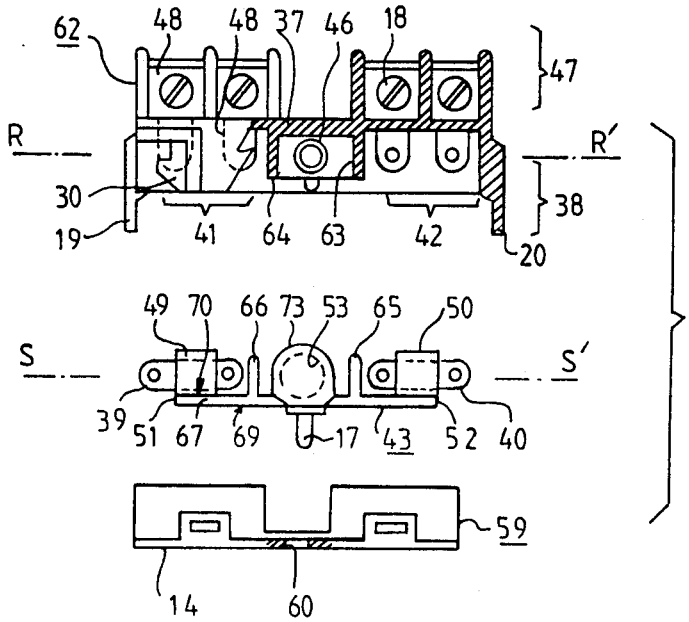
FIG. 7 is an exploded view, seen from the right, of the main components of the group of auxiliary switches; the cover being visible in half-section through a plane MM' of FIG. 3.
Figure 8:
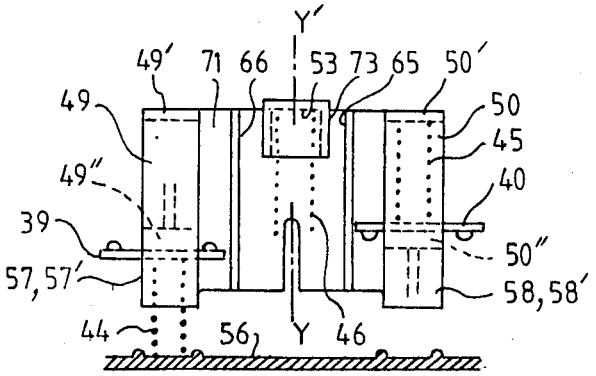
FIG. 8 is a view from above of a movable slide of the group of auxiliary switches.

The slide 43 has a partition 67 in a generally flat shape with an actuating pin 17 on one side 69 and on the other opposite side 70, the two frames 49, 50, the cavity 53 and two partitions 66, 65, parallel to the axis YY', located on both sides of the cavity (see FIGS. 8, 9 and 6).

The exterior surface 73 of the cavity is guided between two ribs 63, 64, parallel to YY', which are arranged on a partition 37. The partitions 66, 65 and the ribs 63, 64 form baffles that contribute to insulating the two switches. The frames 49, 50 are each comprised between upper crossbars 49' and 50' respectively, placed in the upper area 71 of the slide, which has the cavity and the lower crossbar 49'' and 50'' respectively, which are extended respectively by two projections: 57–58, 57'–58'. A movable switch contact 40 (type F) is guided into a frame 50, and the pressure spring thus rests on an upper crossbar 50' and the contact bridge 40 rests on a lower crossbar 50'', while a movable contact bridge 39 of the switch (type O) comes to rest on an opposite side of the lower crossbar 49'' under the action of a pressure spring 44 placed between the contact bridge and the bottom 56. Projections such as 57, 57', and 58, 58', guide such a contact bridge laterally (see FIGS 8 and 9).

The contact bridges and the fixed contacts are preferably identical to those of the main contacts. A cover 59, visible in FIGS. 7 and 9, which carries all or a portin of the coupling face 14, complements lateral guidance of the slide and close the volume 38 when it is coupled to the half-casing 62. This cover, which has an oblong opening 60 to permit passage of the actuating pin 17, could have the resilient hooks 30 and 31, and the guidance projections 19, 20, with the objective of having only a small dispersal of dimensions, and of obtaining production using a material that is compatible with the resilient function of the hooks.

However, considering the fact that the switch fixed contacts are directly coupled to the hálf-casing 62, a better chain of tolerance is obtained by making the resilient hooks 30, 31 and the guidance projections 19, 20 an integral part of the half-casing. It makes no difference whether the pins 25, 26 are an integral part of the half-casing or the cover.

All components of this subset 2 may advantageously be produced by molding a thermoplastic material, using those which are most particularly suited to obtaining proper electrical insulation and a resilience compatible with the function of the hooks.

I claim:

1. An electric control device comprising:

(a) a plane supporting member;

(b) a first insulating housing having a base mounted on the plane supporting member; said first housing further having a front face generally parallel to said base and first and second pairs of side faces generally perpendicular to said base and at right angles one with respect to the other, at least one of the side faces of the first pair forming, in a first end region thereof which is opposite the base and extends from one to the other of the side faces of the second pair, a plurality of insulating partitions which are substantially parallel to the said side faces of the second pair, the said side face of the first pair further forming, in a second region thereof which extends from the said base to the first end region, a recess having a substantially flat bottom surface which is substantially parallel to the side faces of the first pair and extends from one to the other of the side faces of the second pair;

(c) a first stationary and movable contact combination mounted in said first housing and disposed to open and close an electric circuit;

(d) operating means mounted in said first housing and disposed to open and close the first stationary and movable contact combination, the said operating means comprising a coil and movable armature combination;

(e) first terminals connecting the said electric circuit to the said first stationary and movable contact combination, the respective first terminals being located between the respective insulating partitions and forming at least one row which is substantially parallel to the base and to the side faces of the first pair;

(f) slot-like means provided in said bottom surface and generally parallel to the side faces of the second pair and to the direction of motion of the said movable armature;

(g) a second insulating housing removably mounted in said recess in engagement upon the bottom surface thereof and mounted within said second housing, and an auxiliary contact device having a second stationary and movable contact combination and an insulating movable contact carrying structure;

(h) means for removably coupling the movable contact-carrying structure of the auxiliary contact device to the said movable armature, said means having a projection which extends through said slot-like means;

(i) hinging means having a pivotal axis substantially parallel to the base and to the side faces of the first pair and removably connecting the second housing to the base and (j) resilient locking means removably connecting the second housing to the first end region of the first housing.

2. An electric control device as claimed in claim 1, wherein the plurality of insulating partitions has first and second outer partitions which are respectively located in the planes of the respective sides of the second pair and the resilient locking means cooperate with the said outer partitions.

3. An electric control device as claimed in claim 1, wherein the hinging means comprise first and second pins integrally mounted on the second housing and first and second cavities provided in said base for receiving the first and second pins respectively.

4. An electric control device as claimed in claim 1, wherein the second housing has first and second projecting lugs and the first housing has first and second grooves, said lugs and grooves being substantially located in the planes of the respective sides of the second pair and the lugs engaging the grooves during pivotal motion of the second housing about the said pivotal axis for positioning the second housing in the recess.

5. An electric control device comprising:

(a) a plane supporting member;

(b) a first insulating housing having a base mounted on the plane supporting member; said first housing further having a frontface generally parallel to said base and first and second pairs of sides faces generally perpendicular to said base and at right angles one with respect to the other, at least one of the side faces of the first pair forming, in a first end region thereof which is opposite the base and extends from one to the other of the side faces of the second pair, a plurality of insulating partitions which are substantially parallel to the said side faces of the second pair, the said side face of the first pair further forming, in a second region thereof which extends from the said base to the first end region, a recess having a substantially flat bottom surface which is substantially parallel to the side faces of the first pair and extends from one to the other of the side faces of the second pair;

(c) a first stationary and movable contact combination mounted in said first housing and disposed to open and close an electric circuit;

(d) operating means mounted in said first housing and disposed to open and close the first stationary and movable contact combination, the said operating means comprising a coil and movable armature combination;

(e) first terminals connecting the said electric circuit to the said first stationary and movable contact combination, the respective first terminals being located between the respective insulating partitions and forming at least one row which is substantially parallel to the base and to the side faces of the first pair;

(f) a second insulating housing removably mounted in said recess and having a coupling face for engagement upon the bottom surface of said recess and mounted within said second housing, and an auxiliary contact device having a second stationary and movable contact combination and an insulating movable contact carrying structure;

(g) coupling means for removably coupling the movable contact-carrying structure of the auxiliary contact device to the said movable armature;

(h) hinging means having a pivotal axis substantially parallel to the base and to the side faces of the first pair and removably connecting the second housing to the base;

(i) resilient locking means removably connecting the second housing to the first end region of the first housing;

(j) the second housing comprises a half-casing having outer and inner spaces, and an insulating partition located between said inner and outer spaces and substantially parallel to the said coupling face, second terminals mounted in the outer space, cover means closing the said half-casing and having the said coupling face, the said resilient locking means being arranged on the half-casing.

6. An electric control device as claimed in claim 5, wherein the said half-casing has first and second projecting lugs and the first housing has first and second grooves, said lugs and grooves being substantially located in the planes of the respective sides of the second pair and the lugs engaging the grooves during pivotal motion of the second housing about the said pivotal axis for positioning the second housing in the recess.

7. An electric control device as claimed in claim 5, wherein the said insulating contact carrying structure comprises a movable slide and means for mounting the said slide in the said inner space of said half-casing for translating motion parallel to the side faces of the second pair, said coupling means comprising a projecting member mounted on said movable slide, said second stationary and movable contact combination having movable contacts and means for supporting the said movable contact on said movable slide.

8. An electric control device as claimed in claim 7, wherein the said second stationary and movable contact combination has fixed contact members which are placed in a plane which is at right angles with the said translating motion, said contact members having two conductive sides and means for mounting the said fixed contact members within the said inner space for cooperation of said movable contacts with anyone of the two conductive sides of the fixed contact members.

* * * * *